US010676912B1

(12) United States Patent
Davis

(10) Patent No.: US 10,676,912 B1
(45) Date of Patent: Jun. 9, 2020

(54) DOMESTIC APPLIANCE FLOOR DRAIN ASSEMBLY AND METHOD

(71) Applicant: Michael Phillip Davis, Aragon, GA (US)

(72) Inventor: Michael Phillip Davis, Aragon, GA (US)

( * ) Notice: Subject to any disclaimer, the term of this patent is extended or adjusted under 35 U.S.C. 154(b) by 0 days.

(21) Appl. No.: 16/213,409

(22) Filed: Dec. 7, 2018

(51) Int. Cl.
*E03F 5/04* (2006.01)
*E04F 15/02* (2006.01)
*E04F 15/10* (2006.01)

(52) U.S. Cl.
CPC ..... *E03F 5/0407* (2013.01); *E04F 15/02177* (2013.01); *E04F 15/105* (2013.01); *E04F 2290/00* (2013.01)

(58) Field of Classification Search
CPC ..... E03F 5/0407; E04F 15/02177; E04F 2290/00; E04F 15/105
See application file for complete search history.

(56) References Cited

U.S. PATENT DOCUMENTS 6,272,804 B1 * 8/2001 Leis ..... E03F 5/0407 210/164
9,394,651 B2 * 7/2016 Sawyer ..... E01C 11/225
2016/0326752 A1 * 11/2016 Foura ..... E04F 15/02183

* cited by examiner

*Primary Examiner* — Patrick J Maestri
(74) *Attorney, Agent, or Firm* — Thomas | Horstemeyer, LLC

(57) ABSTRACT

The present disclosure describes a domestic appliance floor drain assembly and related methods for implementing a domestic appliance floor drain assembly. In one such embodiment, an exemplary domestic appliance floor drain assembly includes a floor drain liner with a basin to collect fluids that may be leaking from a domestic appliance; and a floor drain insert configured to fit within the basin, wherein the floor drain insert has a rigid structure that is configured to direct leaking fluids from the domestic appliance to an opening in the floor drain liner.

19 Claims, 14 Drawing Sheets

DOMESTIC APPLIANCE FLOOR DRAIN ASSEMBLY AND METHOD

TECHNICAL FIELD

The present disclosure is generally related to floor drainage systems to compensate for water leaks for buildings.

BACKGROUND

A typical house having a wood frame structure has multiple domestic appliances that can be a source of a potential water leak, such as a refrigerator, a dishwasher, hot water heater, sink, washing machine, etc. If such an appliance does suffer a large water leak, then there is usually nothing available within the structure of the house to control and divert the water away from other structures in the house, such as a neighboring hardwood floor, carpet, walls, furniture, etc., which are subject to being possibly damaged. While many conventional techniques provide for drain pans to be deployed under an appliance, such as a refrigerator or dishwasher, these devices are difficult to access, position, and are limited in effectiveness. Thus, improvements in handling water leaks within buildings having a wood frame structure are needed. Otherwise, a failure to control water leakage can be a costly error that requires substantial repair.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

In various embodiments, the present disclosure provides a domestic appliance floor drain assembly and related methods for implementing a domestic appliance floor drain assembly. For example, a water (or other type of fluid) leak by a home appliance (e.g., refrigerator, washing machine, etc.) can lead to water penetrable surfaces of a home, such as hardwood flooring, being exposed and damaged beyond repair. To aid in preventing such accidents, embodiments of a domestic appliance floor drain assembly provide a mechanism for directing water or fluids from an appliance leak away from the interior of a home. Further, in accordance with the present disclosure, such a mechanism may be retrofitted and installed in preexisting homes having a traditional wood frame structure or may be installed when a new floor is installed in a new building structure.

Figure 1:
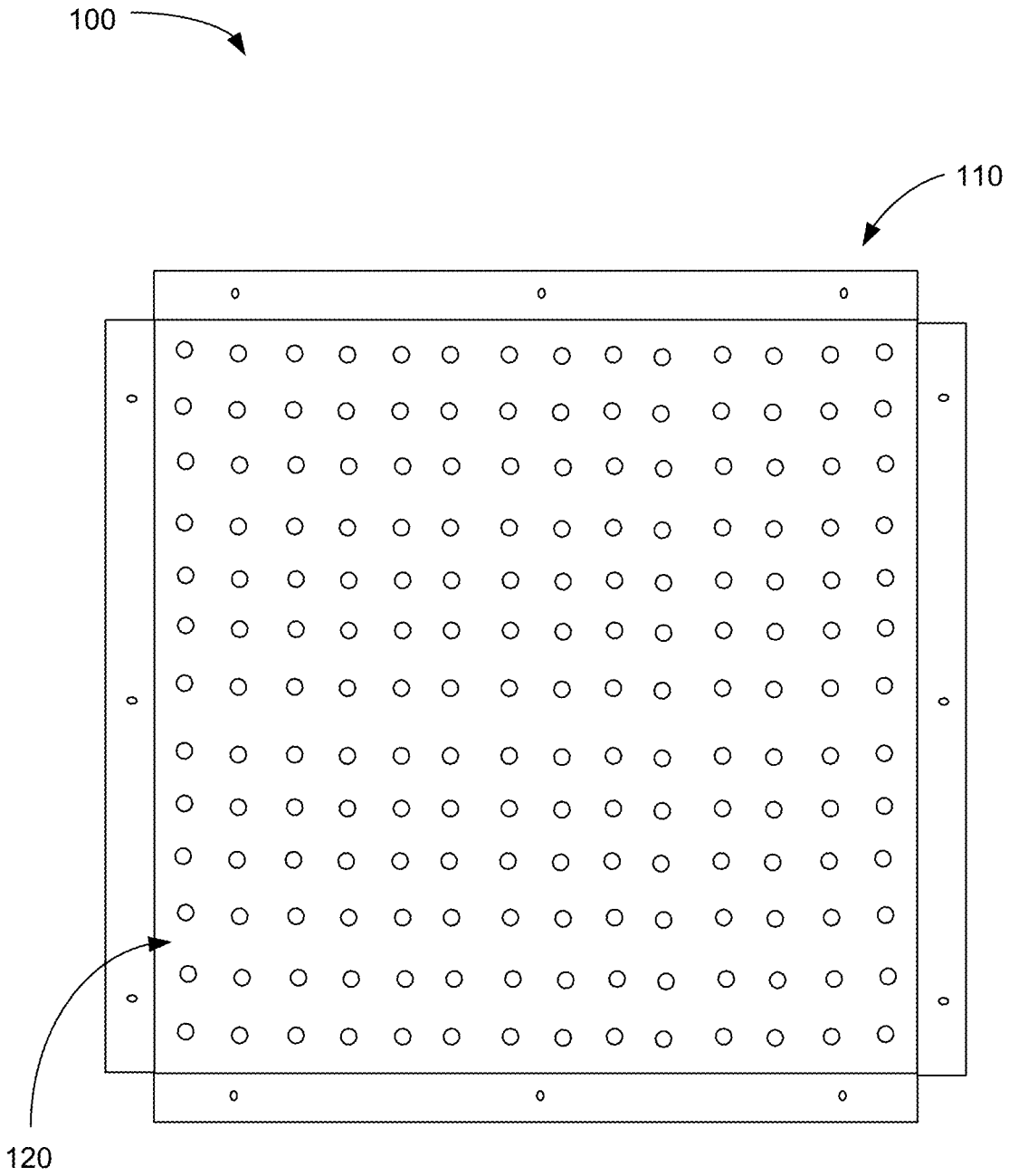
FIG. 1 is a top view of an embodiment of a domestic appliance floor drain assembly in accordance with embodiments of the present disclosure.

As shown in FIG. 1, a top view of an embodiment of the domestic appliance floor drain assembly 100 is depicted, in which the domestic appliance floor drain assembly 100 comprises a floor drain liner 110 that provides a basin 110*f* (FIG. 2) to collect water that may be leaking from an overhead or neighboring domestic appliance. The domestic appliance floor drain assembly 100 further includes a floor drain insert 120 that fits within the basin 110*f* (FIG. 2) and provides a rigid structure that is configured to support the weight of a large appliance, such as a refrigerator, a dishwasher, hot water heater, sink, washing machine, etc., and is configured to direct leaking water from a bottom of the domestic appliance to the drain opening of the floor drain liner that is below it via a plurality of drain holes, channels, and pedestals within the floor drain insert 120.

Figure 2:
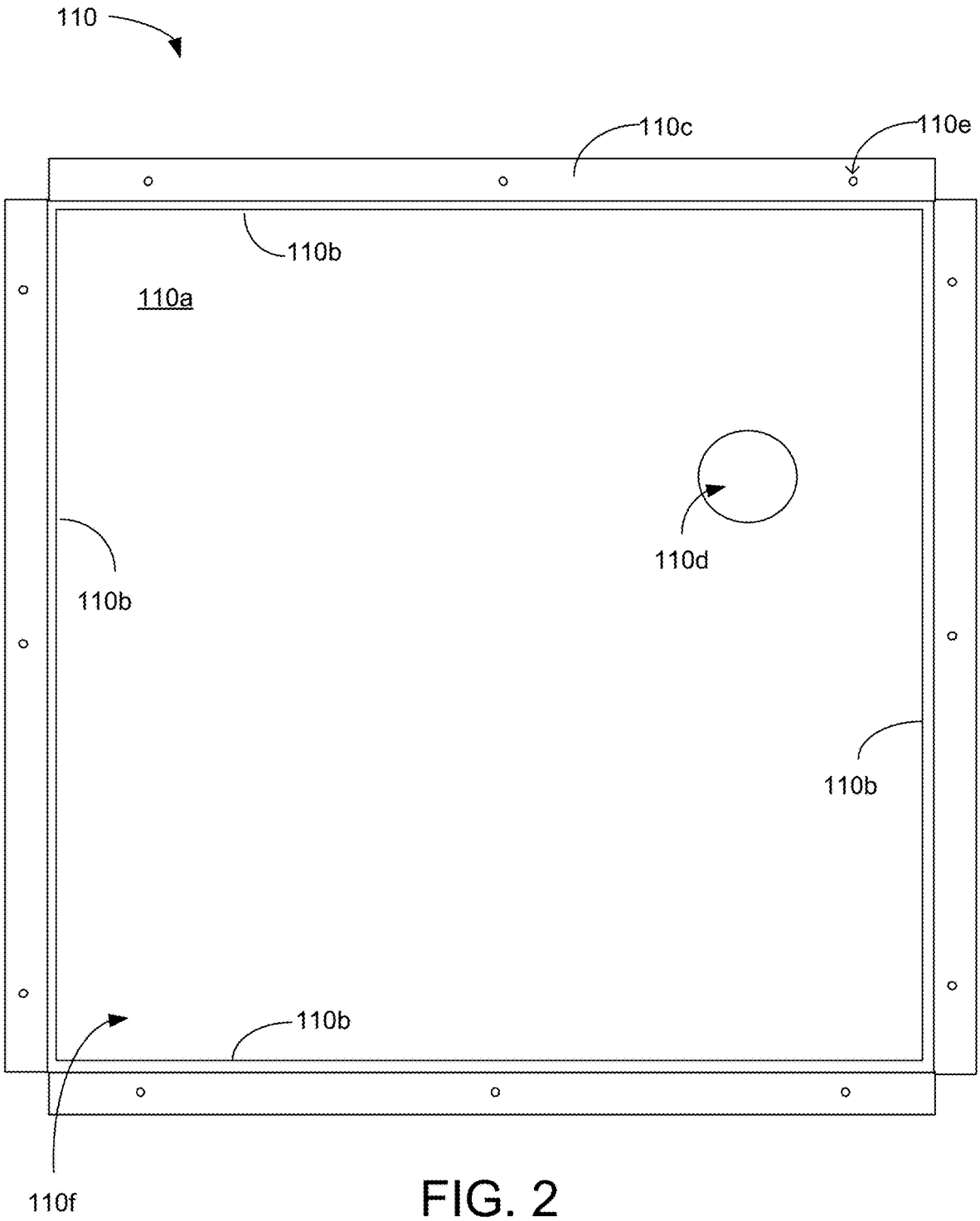
FIG. 2 is a top view of an embodiment of a floor drain liner of the domestic appliance floor drain assembly of FIG. 1 in accordance with the present disclosure.

Referring to FIG. 2, a top view of the floor drain liner 110 is shown, in which the floor drain liner 110 contains a bottom plate 110*a*, four side walls 110*b*, and a plurality of supporting extensions or rims 110*c* that extend outwardly in a horizontal direction from a top of the side walls 110*b*. In operation, the bottom plate 110*a* and the side walls 110*b* form a basin 110*f* to collect water that may be leaking from an overhead or neighboring domestic appliance or some other source of water that is leaking.

In various embodiments, the bottom plate 110*a* of the floor drain liner 110 may feature a circular opening 110*d* having a drain that can be coupled to a drain line or pipe that allows for fluids to exit the building structure. In some embodiments, the circular opening may be set by a user (e.g., by cutting or drilling a hole in the bottom of the floor drain liner 110) such that the opening may be positioned at a spot in the floor drain liner 110 that is near a junction point of a drain line below a subfloor. In one embodiment, a 2-inch drain line (diameter=2 inches) is used to provide sufficient egress for removing water from the basin 110*f* before a potential overflow situation can develop. In other embodiments, different sized drain lines may be used. In various embodiments, the drain line is extended under a subfloor to an outer perimeter of the building allowing excess water to be directed away from an interior of a building/house (where valuable objects/structures reside) to the exterior.

Figure 3:
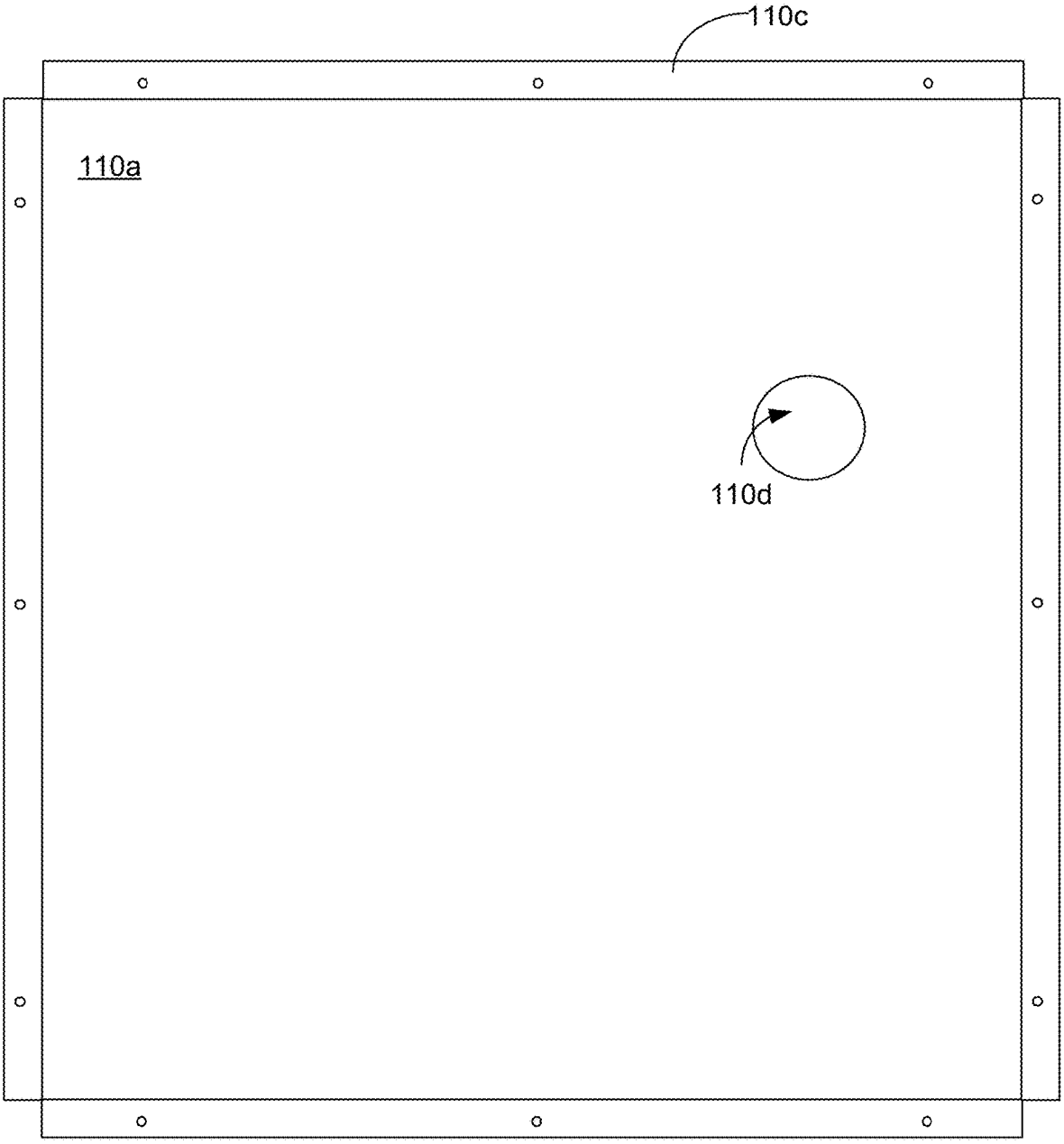
FIG. 3 is a bottom view of an embodiment of a floor drain liner of the domestic appliance floor drain assembly of FIG. 1 in accordance with the present disclosure.
Figure 4:
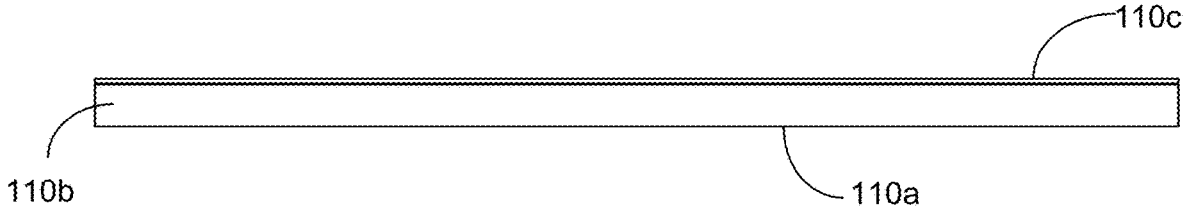
FIG. 4 is a side view of an embodiment of a floor drain liner of the domestic appliance floor drain assembly of FIG. 1 in accordance with the present disclosure.
Figure 5:
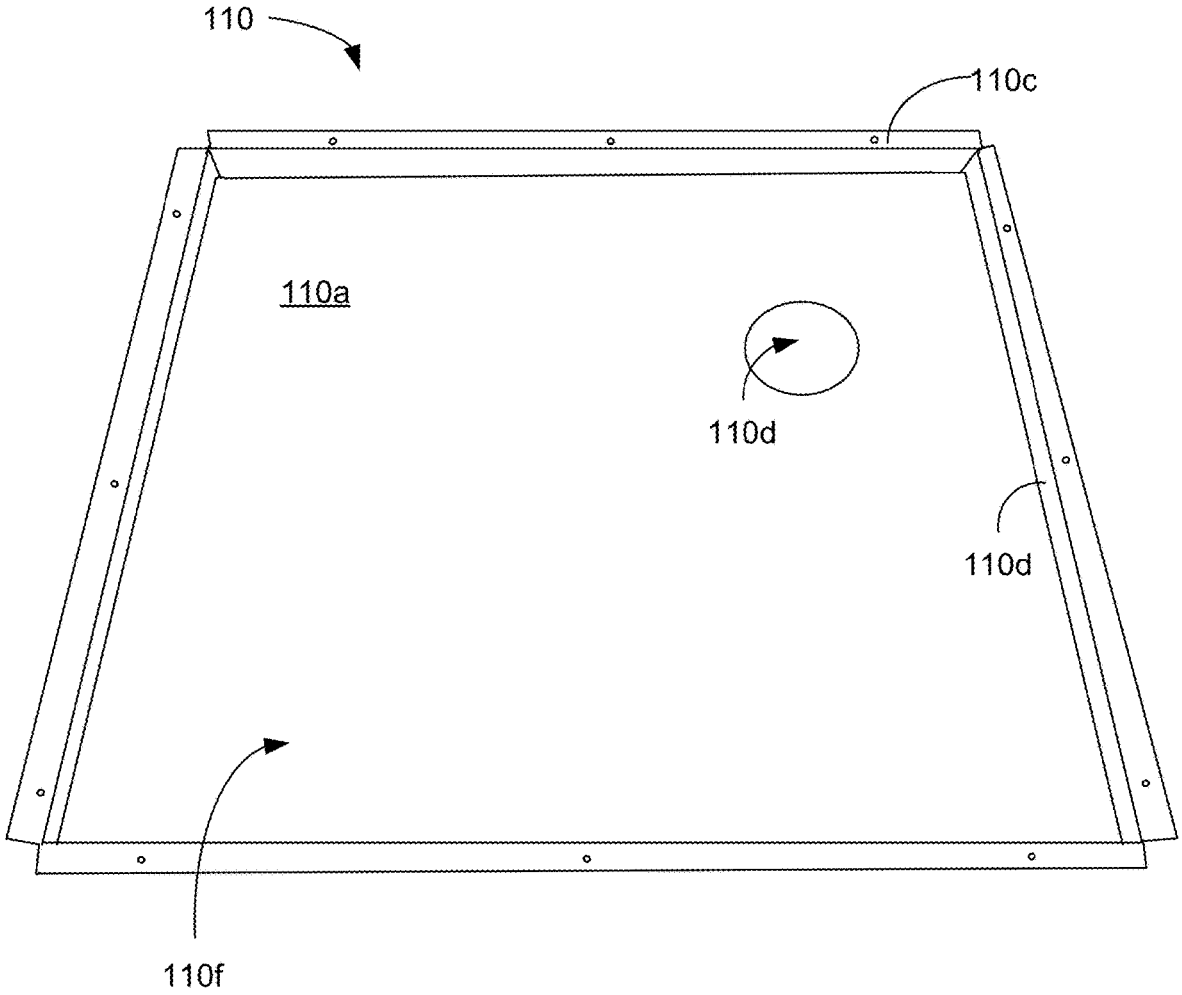
FIG. 5 is a perspective view of an embodiment of a floor drain liner of the domestic appliance floor drain assembly of FIG. 1 in accordance with the present disclosure.

FIGS. 3-6 provide additional views of the floor drain liner 110 in accordance with various embodiments. In particular, FIG. 3 shows a bottom view of the floor drain liner 110. FIG. 4 shows a side view of the floor drain liner 110, and FIG. 5 shows a perspective view of the floor drain liner 110, in accordance with various embodiments of the present disclosure.

As a whole, in some embodiments, the floor drain liner 110 is a stamped metal part, such that the bottom plate 110*a*, side walls 110*b*, and extensions 110*c* are formed from a single sheet of metal. Further, in some embodiments, the floor drain liner 110 is made from galvanized or stainless steel. The floor drain liner 110 is generally of a rectangular shape corresponding to the footprint size of a domestic appliance that rests on top of it. For example, in the case of the domestic appliance being a refrigerator having a 36 inch width and a 36 inch depth, the dimensions of the floor drain liner 110 may be the same as the refrigerator (36 in.×36 in), may be marginally reduced in size (34 in.×34 in.) as compared to the dimensions of the domestic appliance, or could be marginally increased in size (38 in.×38 in.). In one embodiment, the floor drain liner 110 is an 18 gauge stainless steel material (e.g., 440 series stainless steel) having a 0.75 inch depth corresponding to the thickness of the flooring surrounding it. As such, the floor drain liner 110 comprises an impermeable surface, such as stainless steel, among others, that holds the water or other liquid that leaks from the domestic appliance above it.

Figure 6:
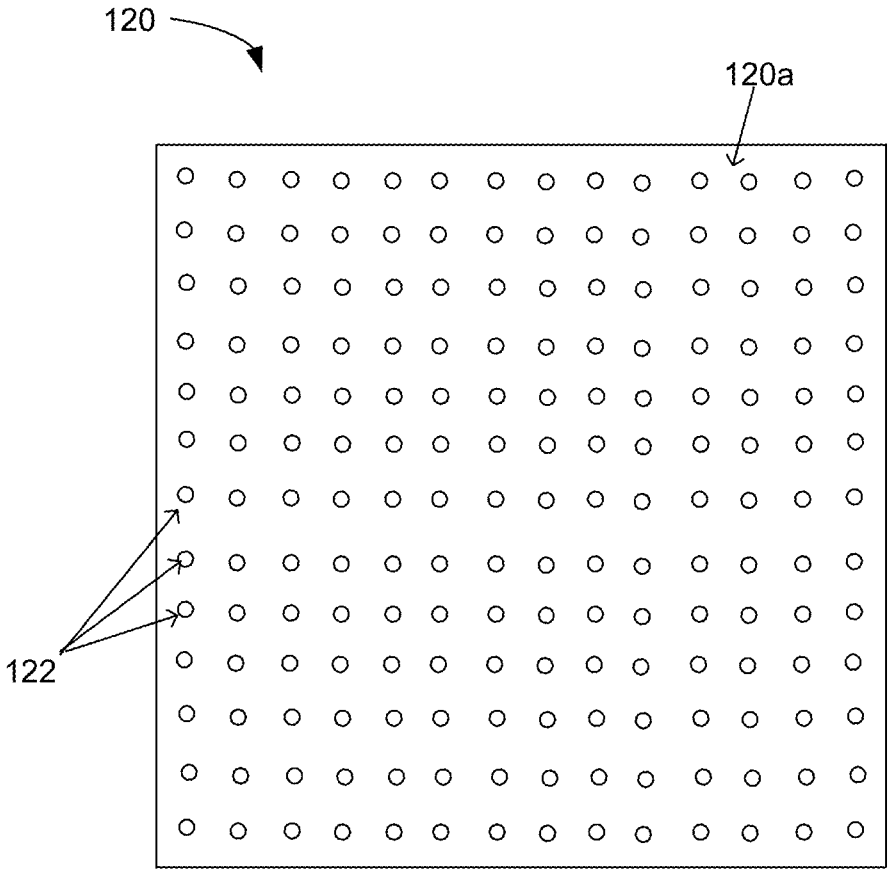
FIG. 6 is a top view of an embodiment of a floor drain insert of the domestic appliance floor drain assembly of FIG. 1 in accordance with the present disclosure.

In various embodiments, a floor drain insert 120 is positioned within the floor drain liner 110 of the domestic appliance floor drain assembly 100 and is flush or level with the adjacent flooring within the building. In various embodiments, the floor drain insert 120 comprises a top surface 120*a*, side surfaces 120*b*, and a bottom surface 120*c*, as depicted in FIGS. 6-9. In particular, FIG. 6 shows a top view of the floor drain insert 120 in which rows (or other arrangement) of a plurality of drain holes 122 are provided in a top surface 120*a* of the floor drain insert 120.

Figure 7:
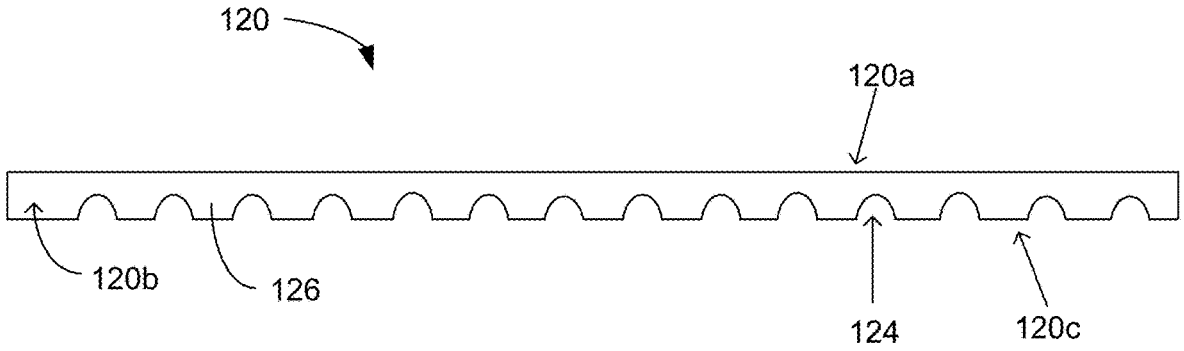
FIG. 7 is a side view of an embodiment of a floor drain insert of the domestic appliance floor drain assembly of FIG. 1 in accordance with the present disclosure.
Figure 8:
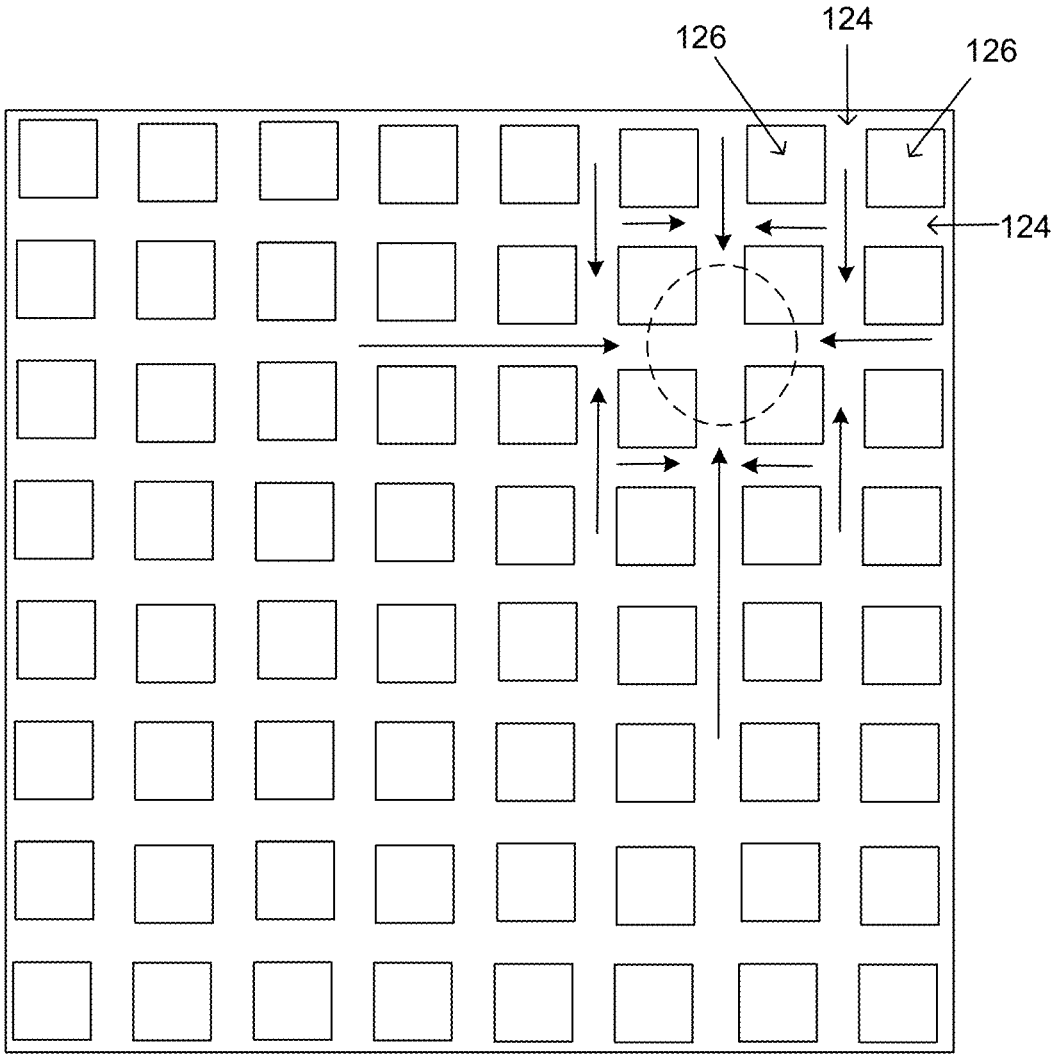
FIG. 8 is a bottom view of an embodiment of a floor drain insert of the domestic appliance floor drain assembly of FIG. 1 in accordance with the present disclosure.

Next, FIG. 7 shows a side view of the floor drain insert in which portions of the top surface 120*a*, the side surface 120*b*, and the bottom surface 120*c* are visible. On the bottom surface 120*c*, a series of rows of support pedestals 126 are provided along the bottom of the insert (e.g., spaced throughout the bottom of the insert in both lateral and longitudinal directions) to form a foundational base for the weight of a weight bearing object resting on it, such as a domestic appliance, pool of water, a person, etc. Surrounding the pedestals are flow channels 124 in which water and fluids may be directed towards the drain opening 110*d*. The flow channels 124 are in fluidic communication with the series of drain holes at the top of the floor drain insert 120. Accordingly, water or other fluid may be directed from the top of the floor drain insert 120 to the floor drain liner 110, as represented by the arrows shown in FIG. 8. In particular, FIG. 8 depicts a bottom view of the floor drain insert 120 and the dashed circle represents the location of the drain opening 110*d* of the floor drain liner 110.

Figure 9:
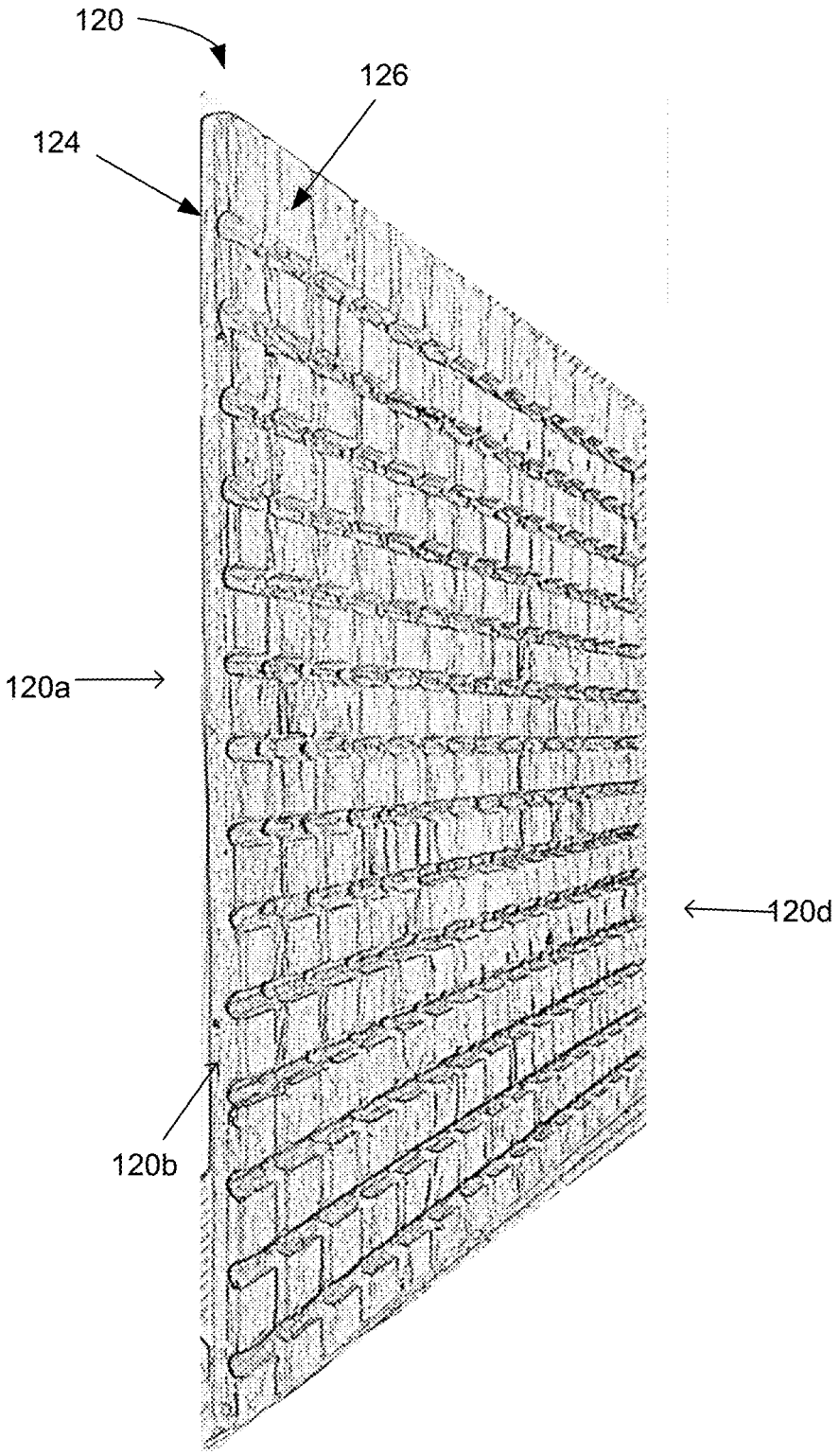
FIG. 9 is a perspective view of an embodiment of a floor drain insert of the domestic appliance floor drain assembly of FIG. 1 in accordance with the present disclosure.

The size of the floor drain insert 120 compliments the interior size of the floor drain liner 110 such that the floor drain insert 120 may be inserted within the floor drain liner 110. In various embodiments, the floor drain insert 120 is designed to withstand a large amount of weight without failure, such as without risk of cracking or breaking the floor drain insert 120. Accordingly, in one embodiment, the floor drain insert 120 is formed from a polymer such as ABS (acrylonitrile butadiene styrene). Important mechanical properties of ABS are impact resistance and toughness. FIG. 9 shows a perspective view of one embodiment of the floor drain insert 120 in accordance with the present disclosure.

Figure 10:
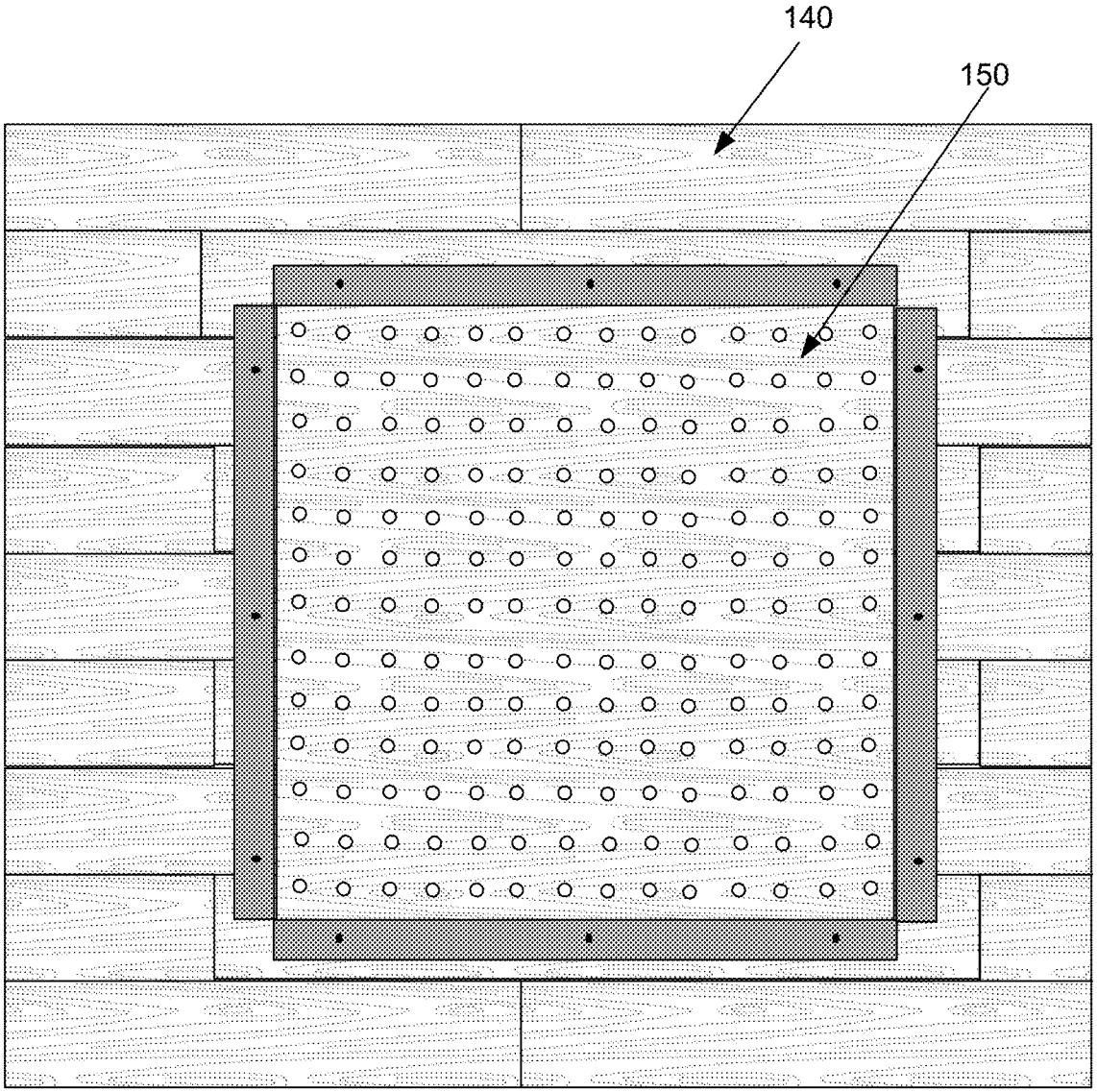
FIG. 10 is a top view of an embodiment of a domestic appliance floor drain assembly having a top level finish that matches the surrounding finished floor in accordance with the present disclosure.

In some embodiments, the floor drain insert 120 may include a top layer that has a finish or coloring that matches or is consistent with the aesthetic of the surrounding floor. For example, although the surrounding floor 140 may be, but not limited to, hardwood floor boards, tile, stone, vinyl, etc., a top layer 150 of the floor drain insert 120 may comprise a water impenetrable surface that resembles the surrounding floor material such as a vinyl tile material, engineered flooring, or laminate flooring, as shown in FIG. 10. Alternatively, the top layer may generally match the color of the surrounding floor or may be a dark color (e.g., black) that is not generally visible underneath the appliance that rests on it. Further, in some embodiments, the top layer may comprise the same material as the surrounding floor such that the floor drain insert will closely match the surrounding floor, even though this material may be penetrated by water and possibly damaged. In this case, the floor drain insert may be replaceable with a new floor drain insert if need be.

Figure 11A:
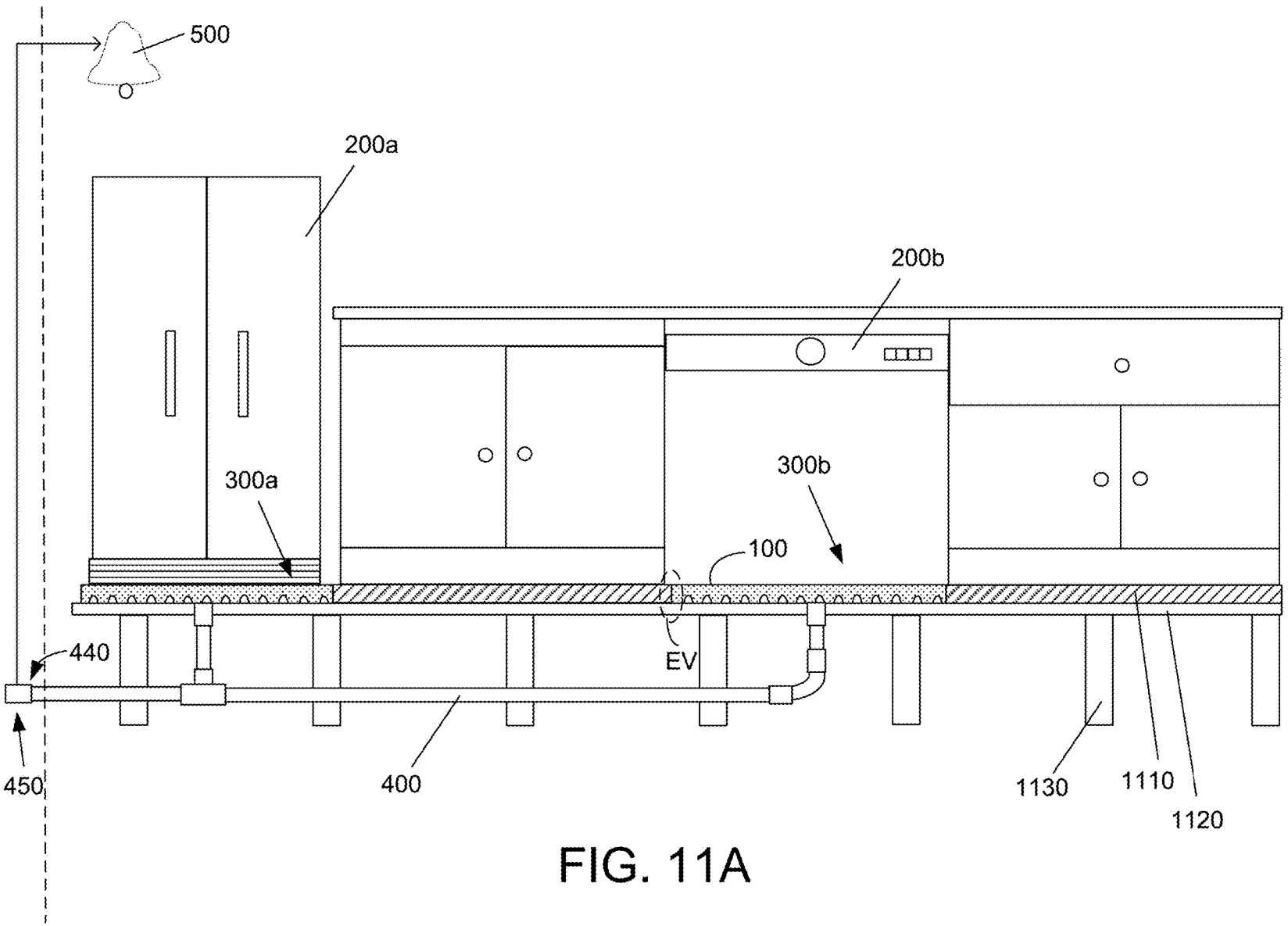
FIGS. 11A-11B are diagrams showing an exemplary installation of domestic appliance floor drain assemblies within a building in accordance with embodiments of the present disclosure.
Figure 11B:
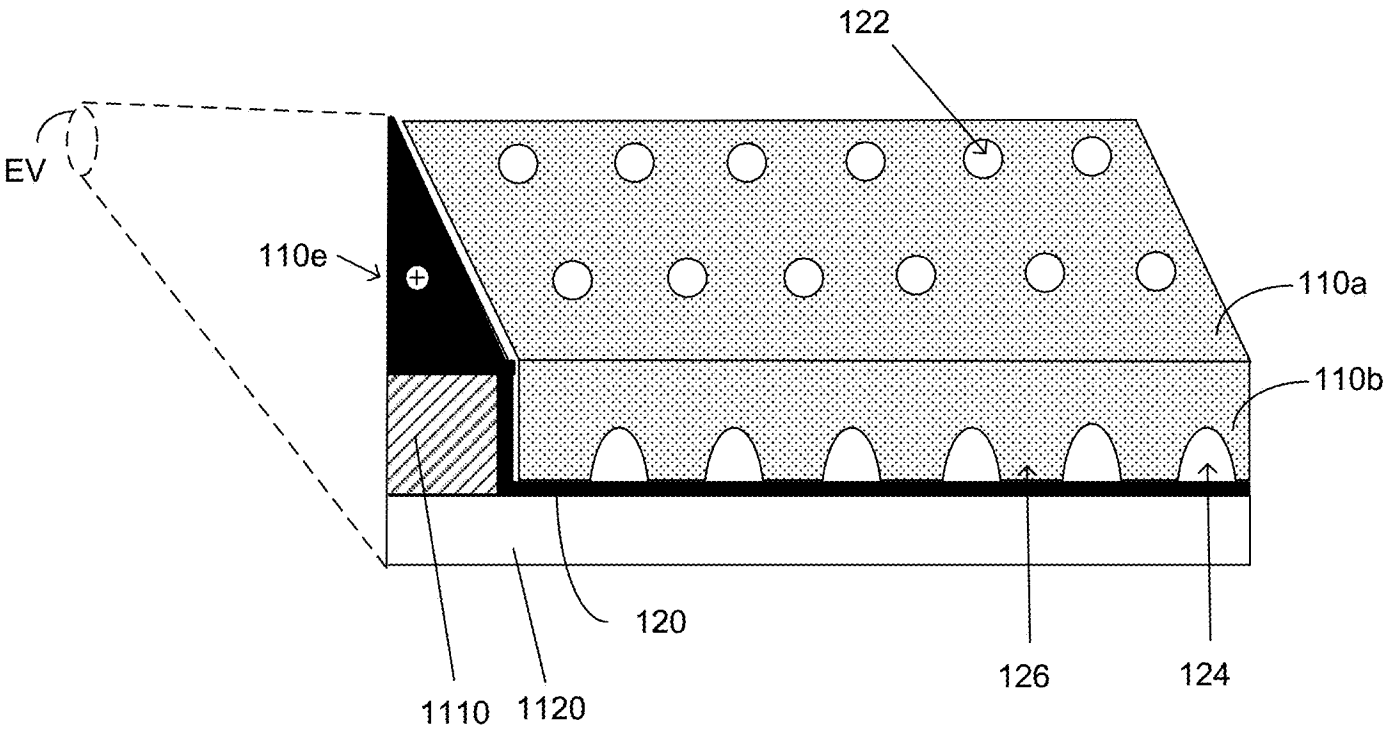
Figure 12:
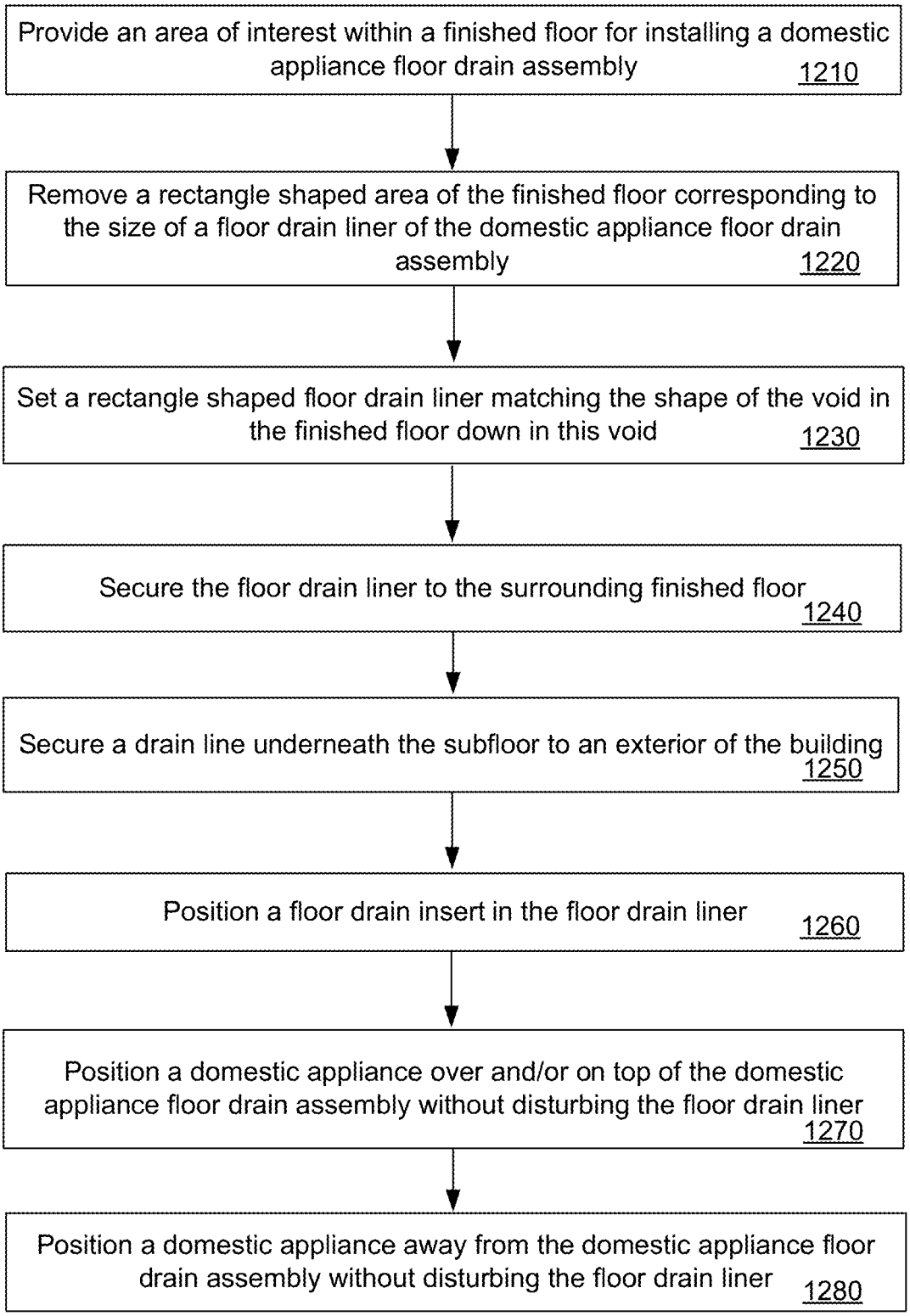
FIG. 12 is a flow chart diagram illustrating an exemplary method for implementing a domestic appliance floor drain assembly in accordance with embodiments of the present disclosure.

In certain embodiments, the present disclosure provides for methods for implementing a domestic appliance floor drain assembly 100 under or near a domestic appliance 200 that that is connected to a water supply line, such as a refrigerator 200*a*, sink, dishwasher 200*b*, etc., that may be a source of a potential water leak. Referring now to FIGS. 11A-B and 12, in one exemplary method, the method comprises the act of providing (1210, FIG. 12) an area of interest 300 within a finished floor 1110 (see FIG. 11A) of a building having a wood frame structure that includes a finished floor 1110, subfloor 1120, and joist 1130 structures. The area of interest 300 corresponds to an area under or adjacent to the domestic appliance that is potentially at risk to a water leak from the water supply line, such as the area 300*a* under a refrigerator 200*a* or the area 300*b* under a dishwasher 200*b*, as non-limiting examples. Next, a rectangle shaped area of the floor is removed (1220), such as by cutting, sawing, hammering, and/or pulling the finished flooring layer 1110 away from the underlying subfloor layer 1120. Then, a rectangle shaped floor drain liner 110 matching the shape of the void in the finished floor 1110, in accordance with the present disclosure, is set down (1230) in this void, such that the extension or rims 110*c* around the top of the floor drain liner 110 overlap with and are secured (1240) to the surrounding finished floor 1110. An enlarged view of this arrangement is provided in FIG. 11B. Here, the floor drain insert 120 is shown to be positioned within the floor drain liner 110 in a void or space adjacent to the finished flooring 1110 above the subfloor layer 1120.

In the case of a traditional wood frame structure, the floor 1110 may have a thickness of 0.75 inches and made of wood, in which case the depth of the floor drain liner 110 (and floor drain insert 120) may be 0.75 inches and secured to the surrounding wood floor 1110 via screws. In another example, the floor 1110 may have a thickness of $\frac{5}{8}^{th}$ inches and be made from a tile material. Thus, the depth of the floor drain liner 110 may also be $\frac{5}{8}^{th}$ inches so that it can sit in the void in the finished floor 1110 and be flush with the surrounding floor 1110. In some embodiments, an insulation may be added between the subfloor layer 1120 and the bottom of the floor drain liner 110. Further, the floor drain liner 110 may be secured to the surrounding tile flooring 1110 by an adhesive instead of screws, in one non-limiting example.

Before or after securing the floor drain liner, a drain line 400 or a series of pipes may be installed (1250) underneath the subfloor 1120 along the joists 1130 to an exterior of the building (as represented by the dashed vertical line in FIG. 11A). The drain line 400 may then be coupled to a drain opening 110*d* in the floor drain liner 110. The top surface of the drain opening may have a mechanical filtration mechanism, such as a screen or strainer, to prevent foreign objects from entering the drain line 400. After the floor drain liner 110 is positioned in the void and the drain line 400 is coupled to the drain opening 110*d*, a floor drain insert 120 can be positioned (1260) in the floor drain liner 110. As previously discussed, the floor drain insert 120 is configured to support the weight of a large domestic appliance, such as a refrigerator, a dishwasher, hot water heater, sink, washing machine, etc., and is configured to direct leaking water from the domestic appliance to the drain opening 110*d* of the floor drain liner 110 that is below it via a plurality of drain holes 122, flow channels 124, and support pedestals 126. In some embodiments, the floor drain insert 120 may include a top layer that matches or is consistent with the aesthetic of the surrounding floor. In some embodiments, the top layer may be painted or stained such that it can be customized to a user's liking.

Accordingly, in a building having a wood frame structure, including floor joists, a subfloor secured to the floor joists 1130, and finished flooring 1110 laid upon the subfloor 1120, a hole may be cut into the finished flooring 1110 in the shape and size of the floor drain liner 110, and the floor drain liner 110 may be lowered into the hole and secured on its sides with screws through screw holes 110*e* (see FIG. 2) provided in the supporting extensions (or rims) 110*c* along the perimeter of the top of the floor drain liner 110 while the subfloor 1120 below provides additional support. The top of the floor drain liner 110 is designed to be flush or level with the top of the adjacent finished flooring 1110. Accordingly, the width of the side wall 110*b* of the floor drain liner 110 corresponds to a width of the finished flooring 1110.

Figure 13:
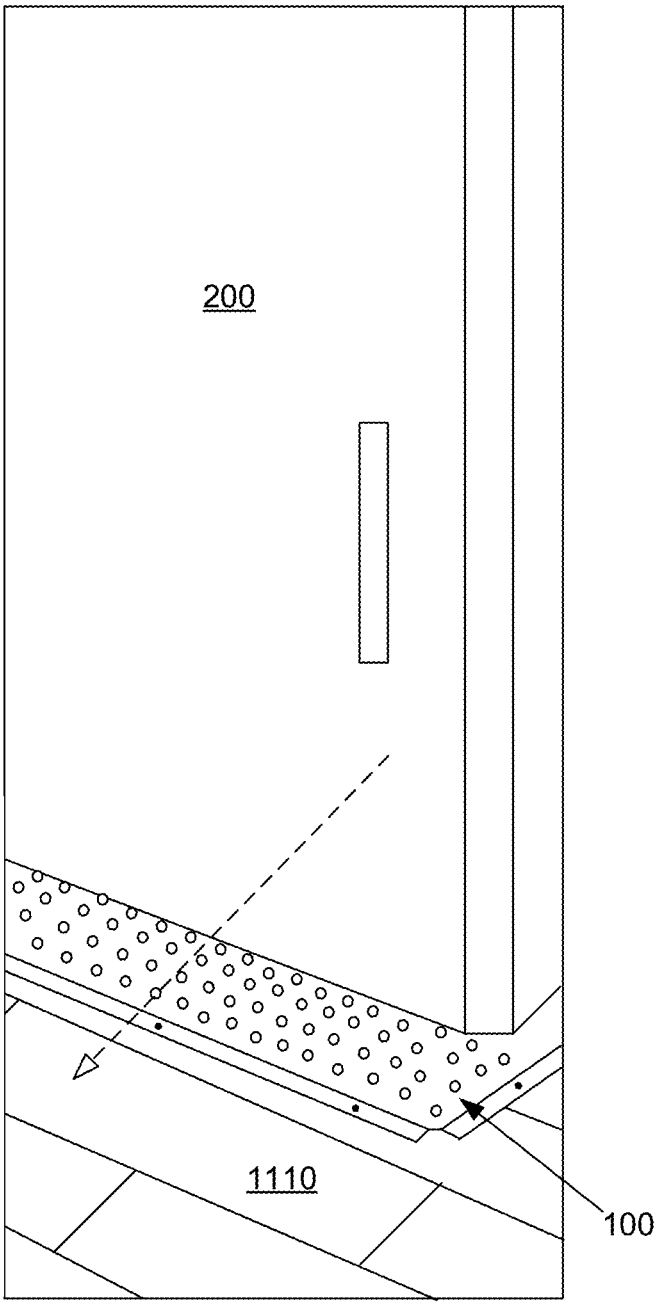
FIG. 13 is a diagram illustrating an exemplary act of positioning a domestic appliance away from the domestic appliance floor drain assembly in accordance with embodiments of the present disclosure.

Referring back to the installation of the domestic appliance floor drain assembly, after the floor drain insert 120 is dropped into the installed floor drain liner 110, the top of the floor drain insert 120 is flush or level with the top of the surrounding finished flooring 1110 of the building. Thus, a domestic appliance 200 can be easily positioned (1270) over and/or on top of the domestic appliance floor drain assembly 100 (e.g., by sliding the domestic appliance 200 to and on the top of the domestic appliance floor drain assembly 100) without disturbing the floor drain liner 110 (which may contain water/fluids). Plus, in the instance of a water leak, the domestic appliance 200 can also be easily positioned away from (1280) the top of the domestic appliance floor drain assembly 100 (e.g., by sliding the domestic appliance 200 away from the top of the domestic appliance floor drain assembly 100, as shown in FIG. 13) without disturbing the floor drain liner 110 (which may contain water/fluids). Thus, unlike conventional drain pans that sit on top of the finished floor, a domestic appliance does not have to be lifted up and over the drain pan, or unlike a conventional drain pan that is mounted to the domestic appliance, leaked water captured in the drain pan is not at risk of being spilled during the process of moving the domestic appliance. For example, if a refrigerator is being moved from one location to another, a drain pan that is mounted to the refrigerator could spill as a result of the movement of the refrigerator, including if the refrigerator was tipped onto a dolly, as is often the case in moving a large domestic appliance.

Advantageously, by the floor drain liner 110 being formed from a metal material in accordance with an embodiment of the present disclosure, the sound of flowing water from an accidental water leak within a domestic appliance may be audibly detected by a person within the building structure due to the pinging sound the water makes in contact with the metal. However, in some embodiments, a leak sensor device 450 (FIG. 11A) may also be used with the domestic appliance floor drain assembly 100 to aid in detection of a water leak. For example, in one embodiment, a drain line 400 runs to an exterior of the building and allows for water to exit the drain line at an outlet portion 440 of the pipe. To detect running water which is evidence of a water leak inside the building, the leak sensor device 450 may be positioned at the opening of the outlet pipe 440 and coupled to an audible alarm 500. In one embodiment, the leak sensor device 450 contains electrical contacts that when they become in contact from water, establishes a short circuit that sends an electrical signal to the audible alarm 500 which causes the audible alarm 500 to sound an alert for a water leak. Accordingly, a person inside or near the building can hear the alert which signifies that a water leak has been detected. In addition, the outlet pipe 440 may contain a hinged lid or cover that allows for water to push open the cover to exit the outlet pipe while keeping air from entering back into the pipe.

It should be emphasized that the above-described embodiments of the present disclosure are merely possible examples of implementations, merely set forth for a clear understanding of the principles of the disclosure. Many variations and modifications may be made to the above-described embodiment(s) without departing substantially from the spirit and principles of the present disclosure. All such modifications and variations are intended to be included herein within the scope of this disclosure and protected by the following claims.

Therefore, at least the following is claimed:

1. A method of implementing a domestic appliance floor drain assembly comprising:

selecting an area of interest within a finished floor of a building for installing the domestic appliance floor drain assembly;

removing a rectangle shaped area of the finished floor corresponding to a size of a floor drain liner of the domestic appliance floor drain assembly, wherein removal of the rectangle shaped area of the finished floor creates a void;

setting a rectangle shaped floor drain liner matching a shape of the void in the finished floor down in the void, wherein the floor drain liner provides a basin to collect fluids that may be leaking from the domestic appliance;

securing the floor drain liner to a surrounding finished floor;

securing a drain line underneath a subfloor to an exterior of the building, wherein the drain line is coupled to a singular drain opening in the floor drain liner;

positioning a floor drain insert in the floor drain liner, wherein the floor drain insert is configured to fit within the basin and provides a rigid structure that is configured to direct leaking fluids from the domestic appliance to the drain opening in the floor drain liner; and positioning a domestic appliance over and/or on top of the domestic appliance floor drain assembly without disturbing the floor drain liner, wherein the floor drain insert contains on its bottom surface, a series of rows of support pedestals in both lateral and longitudinal directions to form a foundational bae for supporting a weight of the domestic appliance.

2. The method of claim 1, further comprising after positioning the domestic appliance over and/or on top of the domestic appliance floor drain assembly, moving the domestic appliance away from the domestic appliance floor drain assembly without disturbing the floor drain liner.

3. The method of claim 1, wherein the floor drain insert further comprises a plurality of flow channels adjacent to the support pedestals, wherein the plurality of flow channels are in fluidic communication with a series of drain holes at a top of the floor drain insert.

4. The method of claim 1, wherein a top of the floor drain liner is flush with a top surface of the surrounding finished floor.

5. The method of claim 1, wherein the floor drain liner is formed from stainless steel.

6. The method of claim 1, wherein the floor drain insert is formed from acrylonitrile butadiene styrene (ABS) plastic.

7. The method of claim 1, wherein the domestic appliance is a refrigerator, a dishwasher, a washing machine, a hot water heater, or an ice machine.

8. The method of claim 1, wherein the finished floor is a type of hardwood floor.

9. The method of claim 1, wherein the building has a wood frame structure.

10. A domestic appliance floor drain assembly comprising:

a floor drain liner with a basin to collect fluids that leaking from a domestic appliance; and a floor drain insert configured to fit within the basin, wherein the floor drain insert has a rigid structure that is configured to direct leaking fluids from the domestic appliance to as a singular drain opening in the floor drain liner, the floor drain insert having on its bottom surface, a series of rows of support pedestals in both lateral and longitudinal directions to form a foundational base for supporting a weight of the domestic appliance, wherein the floor drain insert further comprises a plurality of flow channels adjacent to the support pedestals, wherein the plurality of flow channels are in fluidic communication with a series of drain holes at a top of the floor drain insert.

11. The domestic appliance floor drain assembly of claim 10, wherein the floor drain liner is formed from stainless steel.

12. The domestic appliance floor drain assembly of claim 10, wherein the floor drain insert is formed from acrylonitrile butadiene styrene (ABS) plastic.

13. The domestic appliance floor drain assembly of claim 10, wherein the floor drain liner has a rectangular shape and contains a bottom plate, four side walls, and a plurality of extensions extending from the side walls.

14. The domestic appliance floor drain assembly of claim 13, wherein the bottom plate contains a circular drain opening for coupling to a drain line.

15. The domestic appliance floor drain assembly of claim 14, wherein a size of the circular drain opening is 2 inches in diameter.

16. The domestic appliance floor drain assembly of claim 13, wherein a depth of the side walls of the floor drain liner is 0.75 inches, wherein a depth of the floor drain insert is 0.75 inches.

17. The domestic appliance floor drain assembly of claim 10, wherein the floor drain insert comprises a top finished layer resembling a hardwood floor finish.

18. The domestic appliance floor drain assembly of claim 10, wherein the floor drain insert comprises a mechanical filtration mechanism coupled to the drain opening.

19. The method of claim 1, further comprising positioning a leak sensor device at an outlet of the drain line, wherein the leak sensor device detects the presence of fluids within the drain line.

* * * * *